United States Patent [19]

Maag

[11] Patent Number: 4,676,441

[45] Date of Patent: Jun. 30, 1987

[54] PRECISION WOUND YARN PACKAGE AS WELL AS A PROCESS AND DEVICE FOR MAKING THE SAME

[76] Inventor: Fritjof Maag, Fasanenstr. 31, D-6233 Kelkheim, Fed. Rep. of Germany

[21] Appl. No.: 880,635

[22] Filed: Jun. 27, 1986

Related U.S. Application Data

[63] Continuation of Ser. No. 692,924, Jan. 17, 1985, abandoned.

[30] Foreign Application Priority Data

Jan. 18, 1984 [DE] Fed. Rep. of Germany ..... 3401530

[51] Int. Cl.[4] ..... B65H 54/38; B65H 55/04

[52] U.S. Cl. ..... 242/18.1; 242/18 DD; 242/178

[58] Field of Search ..... 242/18.1, 18 R, 18 DD, 242/43 R, 159, 174, 175, 176, 177, 178

[56] References Cited

U.S. PATENT DOCUMENTS

| | | | |
|---|---|---|---|
| 4,049,211 | 9/1977 | Spescha | 242/18.1 X |
| 4,394,986 | 7/1983 | Hasegawa et al. | 242/18.1 X |
| 4,494,702 | 1/1985 | Miyake et al. | 242/18.1 X |
| 4,504,021 | 3/1985 | Schippers et al. | 242/18.1 |
| 4,504,024 | 3/1985 | Gerhartz | 242/18.1 |

FOREIGN PATENT DOCUMENTS

| | | | |
|---|---|---|---|
| 0118173 | 9/1984 | European Pat. Off. | 242/18.1 |
| 39134 | 11/1971 | Japan | 242/18.1 |

*Primary Examiner*—Stanley N. Gilreath
*Attorney, Agent, or Firm*—Burns, Doane, Swecker & Mathis

[57] ABSTRACT

A package comprising a tube onto which a yarn, wire, tape of the like is wound by a precision winding characterized in that during the winding of the package the ratio formed from the speed of rotation of the package and the traverse speed of the yarn remains constant, in order to provide optimum characteristics with respect to the course of the package such as the mass distribution of the yarn of the package and with respect to yarn winding. A process for winding the yarn on the package with a constant circumferential speed and a device for performing the precision winding process is disclosed.

26 Claims, 2 Drawing Figures

PRECISION WOUND YARN PACKAGE AS WELL AS A PROCESS AND DEVICE FOR MAKING THE SAME

This application is a continuation of application Ser. No. 692,924, filed Jan. 17, 1985, now abandoned.

FIELD OF THE INVENTION

The invention relates to a package comprising a tube onto which a yarn, wire, tape or the like is wound as well as a process and a device for making the same.

The precision winding, other than the random winding, is characterized in that during the winding process of the yarn the ratio formed from the speed of rotation of the package and the traverse speed of the yarn remains constant. The number of the double strokes of the yarn guiding head per time unit is customarily used as a measure for the traverse speed of the yarn. A double stroke is one reciprocation of the yarn guiding head along the axial length of the tube. The ratio of the number of revolutions of the package to the number of the double strokes per minute is designated the winding number or winding ratio and represents the number of package revolutions during one reciprocation of the yarn guiding head. A package is understood to be a tube being wound with a yarn.

When the winding number or winding ratio is constant only over a partial course of the package build-up and changes from partial course to partial course, such a course of package is known as a progressive precision winding.

Herein a picture winding or ribbon pattern is called a layer of the yarn having a reverting loop at the axial edge of the package, which when viewing the axial end surface of the package is angularly positioned above the reverting loop of one of the preceding yarn layers. For integral winding ratios the ribbon pattern is positioned over the immediately preceding yarn layer, which results in instabilities in the package build-up and in loop formation during the unwinding of the package. In order to eliminate this disadvantage rational decimal fractions for the winding numbers or winding ratios are used, so that a large number of intermediary layers of the yarn are present between the ribbon pattern and the preceding yarn layer conforming angularly therewith.

The winding number or winding ratio is thus composed of an integral number and a decimal fraction which in the following is designated as a decimal of the winding ratio. The decimal defines the angle position and the distribution of the reverting loops at one end surface or edge of the package.

Packages in the precision winding are customarily made on winding machines wherein the rotating tube and the yarn guiding head are connected with each other by a mechanical gearing. The gear transmission ratio of the gearing can be finely varied so as to be able to set the most favorable winding ratio.

An electronic control circuit is described in German Auslegeschrift No. 19 13 451, which permits a control of the drive for a drive means for the yarn guiding head in accordance with the rotation of the package. This permits the setting of a plurality of desired winding ratios, so that the number of turns can be often changed during the course of the package. A change in the winding ratio during the course of the package may be caused by the requirement that the winding up speed of the yarn onto the package is to be kept constant. A suitable process with an associated device is described in the European patent application with the publication number 55 849. In order to eliminate the disadvantage of a course of package in the precision winding, which consists in an undesirable increase of the winding up speed of the yarn during an increase in the package diameter, it is suggested in that reference that the winding up speed of the yarn changes by no more than 3%.

On the other hand, the winding ratio used during the course of package influences the distribution of the reverting loops of the individual yarn layers on the edge of the package and thereby the mass distribution of the yarn. Thereby packages with an uneven course are often obtained, which is not only disadvantageous during the winding up operation, but also during the unwinding operation.

However, it is very expensive to find the winding ratios which result in a uniform course of package. Hitherto, the course of package had been observed by means of a stroboscope and the unwinding characteristic of the fully wound package had been examined. The conclusions derived therefrom did not yield commonly useable results.In the embodiment described in the aforementioned European patent application the connection between the rotating tube and the traversely moving yarn guiding head is made by means of an analog operating control circuit, which permits slight deviations of the winding ratio. With this a substantially better course of package is obtained in comparison with the random winding wherein the winding ratio continuously changes. However, a package quality in precision winding with an optimum winding ratio could not be achieved.

A good package course requires, among others, a uniform distribution of the yarn mass in the package. Otherwise, density variations do occur which not only adversely influence the optical appearance of the finished wound package, but also result in difficulties during the winding up operation by unbalance and noncircular movement of the tube and also interferes by friction on its circumference during the drive of the package. Above all, the unwinding characteristics of the package during unwinding of the wound up yarn are unfavorably influenced by such density fluctuations.

The described disadvantages burden the practical application of such devices in such a severe manner that it was not possible to introduce them into the market yet, although the package quality obtained thereby is substantially better than the one of the customary package course in a random winding or a precision winding.

OBJECT AND SUMMARY OF THE INVENTION

It is therefore an object of the invention to provide a precision package with optimum characteristics with respect to the course of package, in particular the mass distribution of the yarn of the package and with respect to yarn unwinding; furthermore, a process for winding the yarn on the package with a constant circumferential speed and a device for winding is to be provided.

The package in accordance with the invention is characterized in that the variation of the densitly of the reverting loops of the yarn along the edge of the package between two successive ribbon patterns is smaller than 8, preferably smaller than 4, wherein the density is the number of the reverting loops per one segment of the edge length. In this manner the yarn distribution is equalized during the course of package in such a manner that even with the progressive winding a faultless winding and uniform unwinding of the package is assured without yarn breaking or snarling independent from the type of the yarn.

Advantageously the segment is the 100th of the length of the edge. If the segment is the 10th of the length of the edge the variation, in a further embodiment of the invention, remains smaller than 4, preferably smaller than 2.

A process for winding up in a precision winding a yarn or the like to a package, the tube of which is driven with a constant circumferential speed and a yarn guiding head which is movable traversely along the yarn layers of the package, is characterized by the invention in that the ratio of the number of the revolutions of the package is so adjusted with respect to the number of the double strokes of the yarn guiding head (winding ratio), so that the variation of the density of the reverting loops along the edge length of the package is smaller than 8 between two successive ribbon patterns, preferably smaller than 4, wherein the density is the number of the reverting loops per one segment which is advantageously the hundredth of a part of the perimeter of the package.

Detailed tests have shown that a uniform distribution of the yarn mass can only be achieved when, above all, the reverting loops of the yarn are uniformly distributed around the length of the edge, i.e. the perimeter of the package, during the winding up process. For this, special considerations are required. The angle position u of the n-th reverting loop with respect to the tube axis may be derived from the winding ratio W according to the relation $$u=n\cdot W$$

The decimal fraction of u, in the following designated as ud, defines the layer of the given reverting loop in parts of the package perimeter with respect to a package having a constant radius.

One can divide the package perimeter into k equal segments, called classes, and the distribution of the ud, whose sequence is the result of a preselected number z of double strokes of the yarn guiding head can be tested for these classes. The difference of the number of decimals ud and thereby the number of reverting loops between the class including the highest number of decimals ud and the class including the lowest number of decimals ud is designated to be the span width S which represents the variation of the density of the reverting loops of the yarn along the edge of the package at one side surface after a course of z traverse periods. The span width S represents a measure for the uniformity of the distribution of the z reverting loops over the k classes and thereby represents also the mass distribution of the yarn in the package. Advantageously, a sufficiently high number of double strokes between two successive ribbon patterns is selected for number z.

When observing the variation of the span width S over the total package build up at least over a sufficiently high number z between two successive ribbon patterns for different decimal fractions Wd of the winding ratio W, it can be noted that the span width S becomes either larger or fluctuates within a certain range. Winding ratios which result in ever increasing values of S are not suitable for the package build up in view of the resulting unevenness of the distribution of the reverting loops.

A detailed test for the example of 1,000 successive reverting loops showed that when selecting 100 classes of equal sizes the span width S should at not time be more than 8, preferably more than 4, or when selecting 10 classes of equal sizes the span width S should at no time be more than 4, preferably more than 2, in order to obtain the desired uniformity of the yarn distribution in the package.

The selection of the limit values for the span width S resulting in a good package build up depends on the material of the yarn, that is, the characteristics of the yarn. For a normal material it suffices to meet the upper of the aforementioned limit values, while for a sensitive material it is recommended to meet the lower of the aformentioned limit values for the span width S.

When testing whether a good package build up can be achieved in the meaning of the invention by utilizing one of the aforementioned winding ratios, a supplementary decision may be made from the result of testing whether one class of 100 classes contains already two or more reverting loops after a number of 50 of reverting loops have been passed. If one class is doubly occupied, no good package build up can be expected and the associated winding ratio may be disregarded.

Favorable winding ratios for the package build up can be determined much more accurately by the invention than was hitherto possible with customary practical tests. Packages with excellent winding off characteristics can be wound when utilizing the invention, wherein the ratio of the diameter of fully wound package with respect to the diameter of the tube is not larger than 3 and the mean cross-over angle of the yarn layers corresponds to the volume and the elongation of the yarn material.

The cross-over angle of two superimposed yarn layers on the package is of particular importance. In a preferred further development of the invention it is therefore provided that the cross-over angle of two superimposed yarn layers is determined and that the winding ratio is so adjusted that the cross-over angle is maintained between a predetermined minimum and a predetermined maximum cross-over angle. It is recommended to select the difference between minimum and maximum cross-over angles of no more than 10%. Depending on the characteristics of the yarn material it may be recommended to select the difference not higher than 5%. Since the cross-over angle changes with the increasing diameter of the package, new winding ratios have to be determined at various times during the total package course so as to realize the invention in this embodiment.

When determining favorable values of Wd it will be noted that even a slight deviation results in a serious deterioration of the span width S. Therefore, in a further development of the invention it is provided that the number of the double strokes is changed angle synchronous with respect to the rotation of the tube which, for example, can be achieved by an angle synchronous control of the transmission ratio of tube rotation and drive means for the yarn guiding head.

The transmission ratio of the winding ratio should be maintained accurately in its mean value. A deviation is only permissible in the fifth or even better in the sixth place of the decimal fraction. The integration time for forming this mean value is of secondary importance. It may be a plurality of seconds when the deviations are statistically distributed from the mean value.

On the other hand short time deviations in this transmission ratio should not be so high that successive reverting loops may lay on top of each other. When digitally determining the rotating speed of the package as well as the rotational speed of the drive means for the yarn guiding head, the number of pulses per rotation of the package or the drive means for the yarn guiding head should be selected so high that the maximum possible deviation which is dependent therefrom, in the momentary winding ratio is so low that the error caused thereby in the position of two successive reverting loops is smaller than the determined lowest distance of these two reverting loops as determined by the winding ratio.

During the change from one winding ratio to the next, a certain time lapses until the higher number of the double strokes adjusts itself. During this time, the yarn positioning on the package is performed uncontrolled. It is therefore possible that by accident two successive yarn windings are partially superimposed with respect to each other. This can result in difficulties.

The probability for this to happen depends on the number of noncontrolled double strokes during the change of the traverse frequency. Therefore, this jump should be performed in a very short time. The time required for changing the number of the double strokes depends from the extent of this change, from the mass which must be accelerated and from the drive force being available. A sufficient safety against the direct superimposing of successive yarn layers is obtained in a further development of the invention if the transition of a first winding ratio to a second winding ratio is performed during less than ten double strokes of the yarn guiding head.

A device for winding up a yarn or the like in a precision winding onto a tube which is driveable with a constant circumferential speed by means of a yarn guiding head driven to reciprocate along the length of the tube by a rotating shaft, for example, a reverse thread shaft which is coupled with a motor, the device having a further motor for driving the package at its circumference, further having a control whose output is coupled with the motor for the shaft, as well as incremental transmitters which receive the rotational speed of the shaft and of the package, has in accordance with the invention a computer unit which is coupled with the outputs of the incremental transmitters of tachometers as well as with the outputs of a memory storing constants for determining a transmission ratio between the rotational speeds of the shaft and of the package, and which is coupled with the control. This is advantageous therein that in progressive precision winding only some few decimal fractions of winding ratios are needed for winding up, which may be stored in the memory in addition to other parameters of the device, so that the aforementioned described inventive precision package can be made automatically independent from the type of yarn. It is recommended to provide a circuit which is controlled by the parameters and which triggers the determination of a transmission ratio of a winding ratio by the computer unit. A special advantage for the package build up is obtained according to an embodiment of the invention by a sensing means which senses characteristics of the package build up, for example, the rotating speed of the shaft, the cross-over angle of the yarn layers, and which controls the circuit when one or more of the sensed characteristics reach one or more of the parameters which characterize the package build up. In a further embodiment of the invention a comparison unit may be provided which compares the winding ratio corresponding to one of the parmeters, which is determined by the computer unit, with the decimals of the winding ratios being stored in the memory, and applies to the control a transmission ratio which corresponds to the next larger one of the stored winding ratios from the memory.

For storing of decimals of winding ratios which are suitable for making the inventive precision package, a multiplication device is provided according to a further embodiment of the invention which feeds signals corresponding to a multiple of the winding ratio to a sorting device comparing the received signals with predetermined limit signals and feeding them to storage areas which are associated with the limit signals, as well as a utilization device is provided which is connected to the storage areas and which additionally encompasses the constant memory. The utilization device may according to an improvement of the invention contain an indicating device which indicates the number of occupied memory cells of the storage areas. In a still further embodiment of the invention another comparison device may be associated with the utilization device which compares the difference in the number of occupied cells of the individual storage areas with a predetermined limit signal and, when falling below the limit signal, stores the decimal of the winding ratio being fed to the multiplication device in the memory of constants.

The transmission ratio which represents the ratio of the rotational speed of the shaft to the rotational speed of the package differs from the reverse value of the winding ratio only by the factor which indicates how many double strokes are executed by the yarn guiding head per one rotation of the driving shaft.

The signal for the change-over from one winding ratio to the next may be triggered, for example, by reaching a predetermined rotational speed of the package, or by reaching a predetermined minimum rotational speed of the motor for the shaft of the yarn guiding head, by reaching a predetermined diameter of the package, or by reaching a minimum cross-over angle.

The computer unit establishes the nominal value nc of the shaft from the rotational speed ns of the package being measured by the incremental transmitter, the transmission ratio, the number g of strokes and the winding ratio W and feeds it to the control. The control function for the rotational speed nc is $$nc = ns \cdot (g/W).$$

The decimals Wd of the winding ratio which are stored in the constant memory are made available to the computer unit, which is compared by the computer unit at the time of the changing over to a new winding ratio with a winding ratio W1 which the computer unit had established in accordance with predetermined functions corresponding to the actual rotational speed of the package and the maximum permissible cross-over angle. The computer unit utilizes such new winding ratio from the constant memory which is the next highest winding ratio with respect to the established winding ratio W1.

For example, the preprogrammed functions can take into consideration that the cross-over angle during the package build up remains between a predetermined maximum and a predetermined minimum cross-over angle. In the case of the mentioned European patent application with the publication number 55 849 these function assume the following form: Assume the following:

W1=calculated package ratio (winding ratio)
W=corrected package ratio (winding ratio)
h=traverse stroke of the yarn guiding head
ko=maximum cross-over angle
ku=minimum cross-over angle
vu=circumferential speed of the package
ns=rotational speed of the package
nc=rotational speed of the reverse thread shaft
ncs=switching speed of the reverse thread shaft
g=threads per unit of the reverse thread shaft
f=permissible deviation of the winding up speed For the minimum cross-over angle it is obtained:

$$ku = arc\cos(\cos ko/(1-f))$$

This results to the rotational speed, which causes switching over to a new winding ratio:

$$ncs = \tan ku \cdot g/(2 \cdot h)\ vu$$

It be $$K1 = \tan ku \cdot g/(2\ h)$$

then is $$ncs = K1 \cdot vu$$

The constant K1 is fed into the input unit by the operator. For the example, the value for this is taken from a nomograph or a table including the parameters ko and f and the fixed values of the winding device h and g. The circumferential speed of the drive shaft vu is established by the computer unit from the measured rotational speed of the drive shaft and its diameter.

The package ratio W1 is calculated by the computer unit from the following relation:

$$W1 = (2 \cdot h)/\tan ko\ ns/vu$$

It is $$K2 = (2 \cdot h)/\tan ko$$

it then follows $$W1 = K2 \cdot ns/vu$$

The decimals of the thus calculated winding ratio are replaced by the next higher of the precalculated and programmed favorable decimals Wd and thereby the optimized winding ratio W is formed. The value for K2 is read by the operator from a table and fed into the input unit. The rotational speed vu is calculated from the rotational speed of the drive shaft and its diameter established by the system, and the rotational speed of the package ns is also continuously established by the system.

Thus, the control function of the reverse thread shaft is obtained by $$nc = g/W \cdot ns$$

The mean value of the transmission ratio $i = g/W$ should be very accurately maintained, so that the precalculated favorable distribution of the reverting loops is obtained. Tests have shown that this transmission ratio should be applied to the control with an accurateness of at least 7 decades.

The favourable decimals Wd are established as described. About 20 values which are uniformly distributed over the package circumference suffice to maintain the error in the winding up speed smaller than 0.05%. For Wd at least three decimals are required as an input, so as to determine a sufficient number of favorable decimals Wd.

For filament yarns the package build up, in particular in the inner layers, is more favorable if the winding is performed with a rhombus winding. On the other hand, only the decimals between 0.18 and 0.42 as well as between 0.58 and 0.82 are available for a rhombus winding leading to a reasonable distribution of the reverting loops. In addition, intermediate values are required for higher cross-over angles and smaller permissible deviation in the winding up speed in particlar for the larger package diameters, in order that the functions may be performed.

So that always the most favorable rhombus winding is found in the less problematic smaller diameters, it is advantageous to subdivide the favorable decimals Wd during the input into preferred values and less preferred values.

DESCRIPTION OF THE DRAWINGS

The invention will be described in detail in conjunction with the exemplified embodiment illustrated in the drawing. The drawing shows.

DETAILED DESCRIPTION OF THE PREFERRED EMBODIMENT

Figure 1:
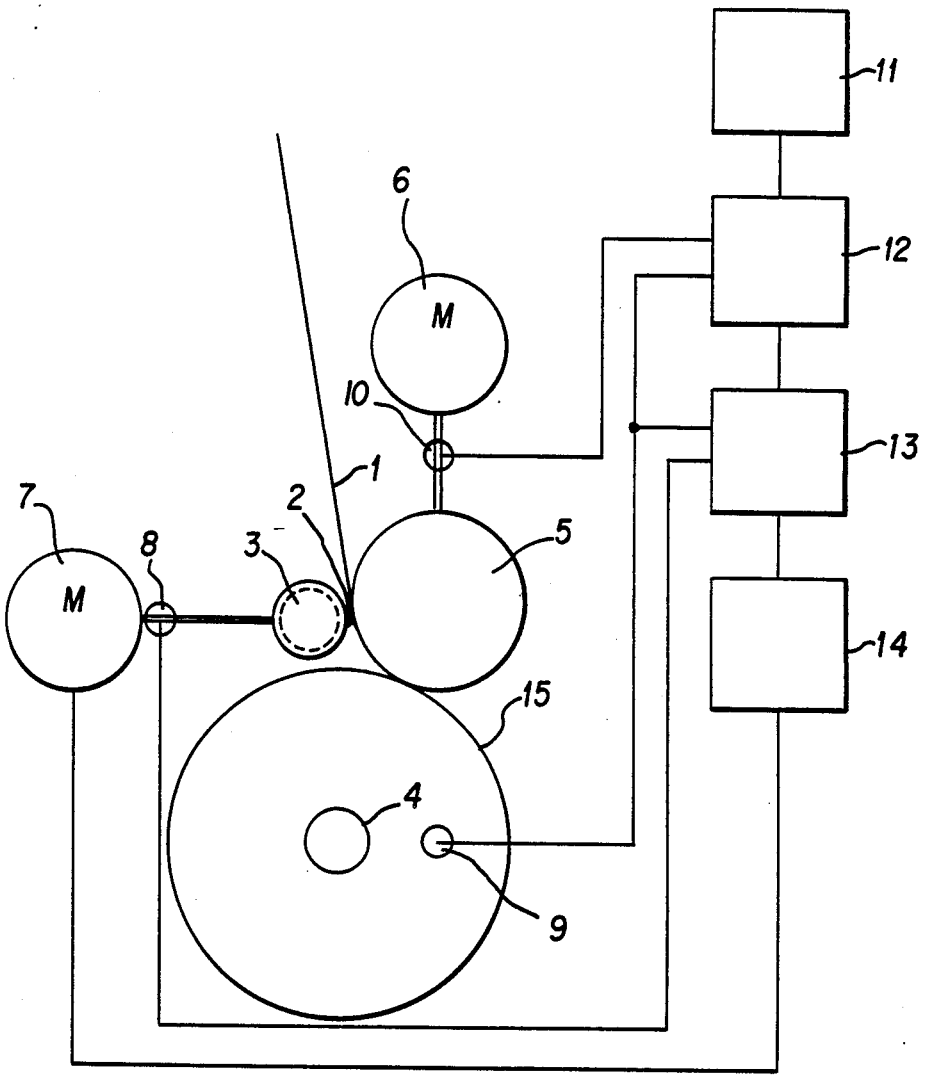
FIG. 1: a schematic view of a winding up device for winding up a synthetic filament yarn from a spinning machine having a constant spin speed on a tube.

A yarn 1 which may be a filament yarn emerges from a spinning nozzle, not shown, of a spinning machine, not shown, and is fed to a yarn guiding head 2 which is guided in the groove of a reverse thread shaft 3. The reverse thread shaft 3 is rotated around its axis by means of a motor 7 and a gear. Because the yarn guiding head 2 is prevented from rotating with the reverse thread shaft and because the groove is cut into the shaft in an inclined directon with respect to the shaft axis, the yarn guiding head is moved in a reciprocating movement along the axis of the reverse-thread shaft 3 and parallel with respect to the length of the tube during the rotation of the reverse thread shaft.

A tube 4 is rotatably mounted on a bearing spindle in such a manner that the axis of the tube 4 extends parallel to the axis of the reverse thread shaft.

At the beginning of the winding operation a drive roller 5 engages the jacket of the tube 4, which is driven by a motor 6 with a desired rotational speed. When the winding up of the yarn on tube 4 proceeds, drive roller 5 engages the outer layer of the yarn of package 15 and drives the package with the desired package rotational speed in view of the friction connection between the drive roller and the outer yarn layer in a constant circumferential speed. Alternatively, the tube may be driven directly by a motor, whose rotational speed is reduced during the course of winding in accordance with the increase of the package diameter.

An incremental transmitter 8, whose output pulses correspond to the rotational speed nc of the reverse thread shaft 3 is provided for picking up the rotational speed of the reverse thread shaft. An incremental transmitter 9 is provided on package 15 for picking up the rotational speed of package 15 and whose output pulses correspond to the rotational speed ns of the package. A further incremental transmitter 10 on the drive roller 5 picks up the rotational speed thereof and emits a corresponding number of pulses.

The control of the winding up device encompasses a memory and input unit 11, wherein a series of decimals Wd of the winding ratio are stored which enable the package build up in accordance with the invention. Furthermore, the constants K1 and K2 as well as the transmission ratio between the rotating frequency of the reverse thread shaft 3 and the traverse frequency g of the yarn guiding head 2 and the diameter of the drive roller 5 are stored in the memory and input unit 11.

A computer unit 12 has access to the constant memory in unit 11 through a line 16. The computer unit 12 receives the output pulses of the incremental transmitters 10 and 9 by means of line 17 and 18, respectively. The computer unit establishes from the rotational speed of the drive roller 5 and the constant K1 from the rotational speed ncs of the reverse thread shaft 3 for the switching over of the winding ratio.

The optimum winding ratio W which had been established by the computer unit 12 is transferred through line 21 to a control 13 which is equipped with a synchronizing device which receives the actual rotational speed nc of the reverse thread shaft 3 through line 19 and controls the rotational speed nc of the drive motor 7 of the reverse thread shaft 3 in an angle synchronous manner with respect to the package rotational speed ns corresponding to the signal received from the control unit 12 through line 21, such control being effected in relation to the rotational speed ns of package 15 which it receives through a branch line of feed line 18. The control is performed by means of a frequency change 14 which is switched subsequent to the control 13 and which is coupled with the motor 7 by means of a line 25.

Figure 2:
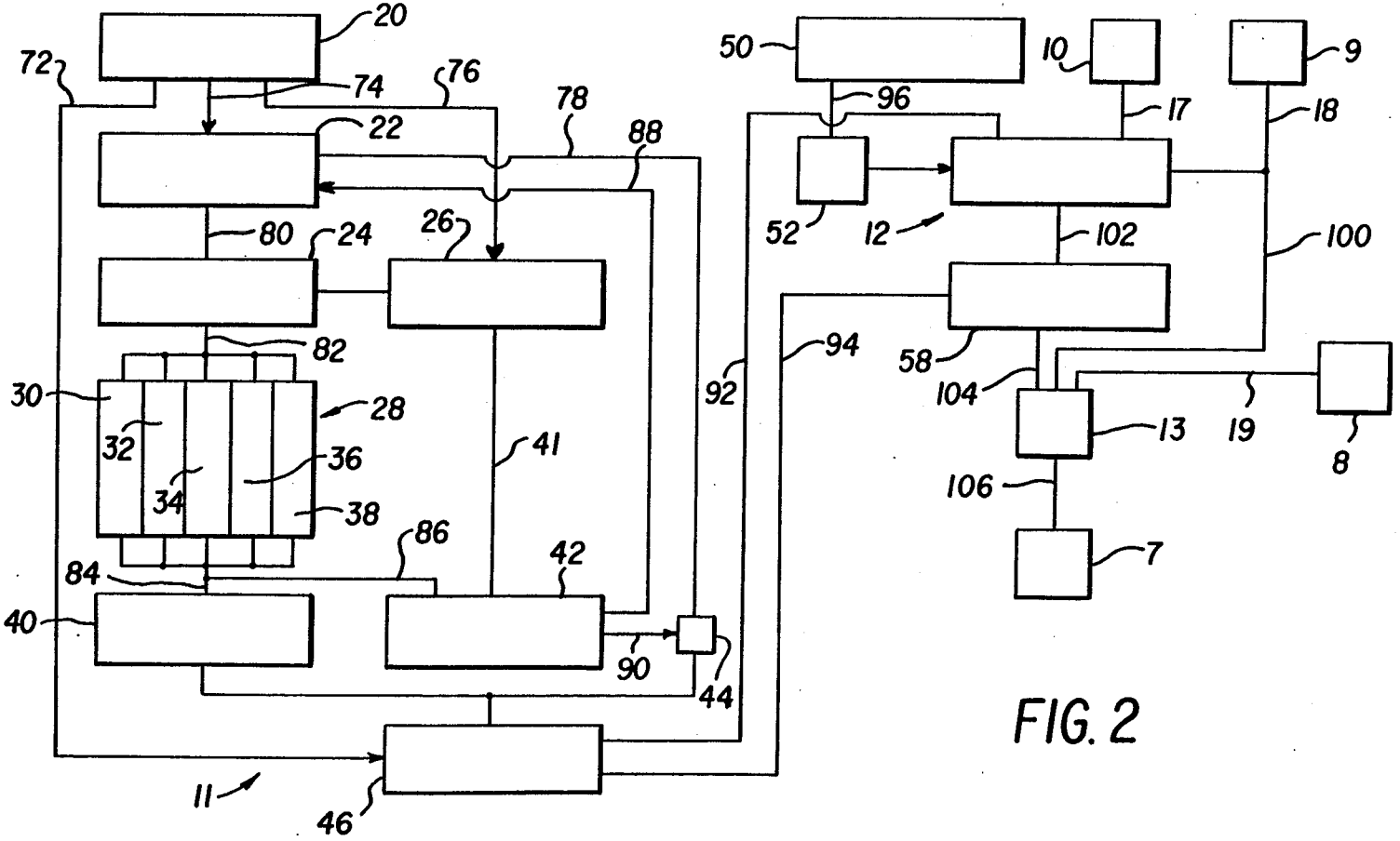
FIG. 2: a circuit diagram of parts of the control of the winding up device in accordance with FIG. 1.

The control ciruit which includes the input unit 11, the computer unit 12 and the control 13 is illustrated in detail in FIG. 2. Winding ratios are successively fed by means of an input device 20 through a line 74 of a multiplication device 22, if need be through an intermediary storage. The multiplication device 22 multiplies each winding ratio successively with the series of the natural numbers and feeds the received results through line 80 to a sorting device 24. The sorting device 24 compares each of the number signals which come from the multiplication device 22 and which correspond to the positions u of the reverting loops, with limit signals which are kept available by the input 20 in a unit 26 through line 76. Each two limit signals define the size of a class k, and therefore also a segment on the standardized circumference on an end surface of package 15. Depending on the comparison result, the sorting device 24 stores the signals ud in the associated storage area of the memory 28 through line 82, which is provided with a number of storage areas corresponding to the number of classes k, the storage areas 30, 32, 34, 36, 38 being illustrated by way of example in FIG. 2. An output line 84 from memory 28 leads to a first comparison device 42. The indicator device 40 shows on a display, not shown, the numbers of occupied cells of the individual storage areas, that is, the number of the number signals contained in each storage area. The comparison device 42 forms the difference of the numbers of occupied cells of the individual storage areas of memory 28 and compares the difference with a further limit signal, which the comparison device 42 receives from the limit signal device 26 by means of line 41. For example, the limit signal may represent the numeral 8. If the comparison of the differences performed by the comparison device 42 with the further limit signal results therein that the differences are below the further limit signal, the comparison device 42 enables through line 90 a gate 44 in a line 78 which leads from the multiplication device to a constant storage 46. The gate 44 is opened in view of its being enabled and the winding ratio contained in the multiplication device 22 is stored in the constant storage 46.

Simultaneously, the stored winding ratio can be visibly displayed on the display of the indicating device 40 by means of line 43.

After completing the comparison by the comparison device 42, the comparison device 42 emits a signal through line 88 to the multiplication device 22 which thereupon processes a winding ratio in the aforementioned manner.

Required constants for the further process, like the constants K1, K2, may be fed and stored into the constant storage 46 by means of the input device 20 through line 72.

A receiving device 50 may contain a video camera with which the cross-over angle of the superimposed yarn layers can be picked up. Alternately, the receiving device 50 may be connected to the incremental transmitter 9 and signal the reaching of a predetermined package rotational speed. The receiving device may also be connected to the incremental transmitter 8 and sense the reaching of the predetermined minimum rotational speed of the reverse thread shaft 3. As a further possibility for the receiving device 50 a sensor is provided which picks up the actual package diameter, whereby the receiving device 50 signals the reaching of a predetermined package diameter.

Independent from the actual type of the receiving device 50 realized in a specific embodiment of the invention, the receiving device 50 emits a trigger signal through line 96 to a circuit 52 which triggers the computer unit 12 accordingly. Every time the computer unit 12 receives a trigger signal from the circuit 52 it establishes the winding ratio W1 from the constant K2 which is read from the constant storage 46 through line 92, and from the received package rotational speed ns for the maximum permissible cross-over angle, whose associated signal is also read from the storage 46 through line 92. The computer unit 12 feeds the decimals of W1 through a line 102 to a second comparison device 58 which reads the stored decimals of the winding ratios from the constant storage 46 through line 94 and compares them with the winding ratio W1 obtained from the computer unit 12. The next largest decimal Wd which is established by the second comparison device 58 with respect to the winding ratio W1 is converted into the transmission ratio $i=nc/ns$ with an accuracy of 7 decades thereby utilizing the number of threads per unit g of the reverse thread shaft 3 which represents the number of double strokes performed by yarn guiding head 2 per one rotation of reverse thread shaft 3, and the result is fed from the second comparison device through line 104 into control 13. The control 13 controls the rotational speed nc of motor 7 or the reverse thread shaft 3 by using the signal which is fed from the incremental transmitter 9 through line 100 and which represents the rotational speed of the package corresponding to the transmission ratio i obtained from the second comparison device 58. The winding up operation is then continued with the new winding ratio W or the associated transmission ratio i, until the receiving device 50 signals circuit 52 the reaching of a further limit value, e.g. representing the minimum cross-over angle. Thereafter, the computer unit establishes a new winding ratio W2 in the same manner as just described.

The incremental transmitter 8 and 9 emit, for example, 500 pulses per rotation of the reverse thread shaft 3 or package 15. Thereby, the possible error in the position of two adjacent reverting loops becomes smaller than 0.001.

The following application examples describe the package build up while winding up a Poy-filament yarn made of polyester. Example 1 was performed with a winding device of a commonly known type for comparison purposes, while the examples 2–4 were performed in accordance with the inventive process. Less preferred decimals used as winding ratios are designated with an * in example 4.

EXAMPLE 1

Cylindrical packages were made from untwisted filament yard dtex 250 with a winding device of the commonly known type having a spindle drive for the package and a gear drive between spindle and reverse thread shaft. The tube diameter was 85 mm, the dimeter of the full package was about 180 mm and the transverse stroke 250 mm.

By exchanging the gears between spindle and reverse thread shaft the winding ratios could be changed in small steps. Packages were made with winding ratios which only differ in their decimal places.

The quality of these packages was evaluated. Thereby, particuiar considerations were given to packages which were not sufficiently yarn-loaded and which showed sloughing-off on the end faces of the packages and snarling during winding off operation. The package quality was graded as follows:

1=excellent
2=good
3=still sufficient
4=insufficient

The positions of 1,000 reverting loops were established on the package end surface for each value of the winding ratio. The positions were sorted into 100 circumferential classes, the difference between the number of positions in the class of highest numbers and the class of lowest numbers was observed and its maximum value was noted as span width S (100).

At 50 and 200 and 1,000 reverting loops, the span width was only determined from 10 circumferential classes and the found maximum deviation was noted as S (10).

Furthermore, it had been noted how many of the 100 circumferential classes included two or more numbers of positions after 50 reverting layers occurred. The number of such classes is designated D (50).

The following values were noted:

| Wd | S (100) | S (10) | D (50) | Grade |
|---|---|---|---|---|
| 0.1297376 | 4 | 4 | 0 | 2 |
| 0.2114179 | 3 | 2 | 0 | 2 |
| 0.3119834 | 4 | 4 | 6 | 3 |
| 0.6880466 | 4 | 4 | 5 | 3 |

-continued

| Wd | S (100) | S (10) | D (50) | Grade |
|---|---|---|---|---|
| 0.7887154 | 5 | 4 | 0 | 3 |
| 0.9533725 | 2 | 3 | 2 | 3 |
| 0.4703153 | 3 | 5 | 17 | 4 |
| 0.5295031 | 8 | 12 | 3 | 4 |

Completely error free packages were not found in this test.

EXAMPLE 2

In a test device for making cylindrical cross wound packages in a progressive precision winding process, the package is driven on its circumference with a constant speed. The package rotational speed is digitally picked up and thereafter the rotational speed of the reverse thread shaft is so controlled that the transmission ratio i between the reverse thread shaft and the package remains constant during the whole course of package build up. In this device, i can be accurately adjusted to 4 decades with a digital potentiometer.

The winding ratios were established from the series of selected optimum steps of the transmission ratios i for a progressive precision winding. With various decimals of these winding ratios, packages corresponding to example 1 were made and evaluated. Furthermore, the distribution of the reverting loops for these winding ratios was determined and evaluated in accordance with example 1. Thereby, the following values were obtained:

| Wd | S (100) | S (10) | D (50) | Grade |
|---|---|---|---|---|
| 0.25685 | 2 | 3 | 0 | 1 |
| 0.15701 | 4 | 2 | 0 | 2 |
| 0.34170 | 2 | 3 | 1 | 2 |
| 0.78446 | 3 | 4 | 0 | 2 |
| 0.82479 | 3 | 2 | 3 | 2 |

Due to the steps predetermined by the conditions of compatibility of the progressive precision winding it is almost impossible to find winding ratios by only three available decades for setting i, which will result in real error free package build up.

EXAMPLE 3

The winding device described in conjunction with FIGS. 1 and 2 is used for making one step precision packages with the dimensons known from example 1. For these tests, decimals of the winding ratios were established with an optimum distribution of the reverting loops. The packages made in this manner were evaluated as in example 1. One obtains the following:

| Wd | S (100) | S (10) | D (50) | Grade |
|---|---|---|---|---|
| 0.21141 | 2 | 2 | 0 | 1 |
| 0.31089 | 2 | 2 | 0 | 1 |
| 0.38316 | 3 | 2 | 0 | 1 |
| 0.78859 | 3 | 3 | 0 | 1 |
| 0.87026 | 2 | 2 | 0 | 1 |
| 0.95325 | 2 | 3 | 0 | 1 |

The possibility for a very finely stepped selection of the transmission ratio i permits to select winding ratios which result in excellent packages, even with the conditions of compatibility of the progressive precision winding.

EXAMPLE 4

12 decimals of the winding ratio were defined with the process described in example 1 and the device as aforementioned described, whose differences are smaller than 0.1 and which are uniformly distributed over the circumference resulting in an optimum distribution of the reverting loops. With these decimals, of which the ones positioned between 0.2 and 0.4 or 0.6 and 0.8 were evaluated as preferred decimals, a series of winding ratios had been developed for the progressive precision winding, wherein the error in the winding up speed will not become larger than 0.05% and which result in the individual winding steps in an excellent package build up.

The following table lists this series for winding up of POY-filaments:

| Progressive Precision Winding | |
|---|---|
| Cross-over angle | 6.4° |
| Circumferential speed of the package | 3500 m/min |
| Permissible deviation of the winding up speed | .05% |
| Threads per unit of the reverse thread shaft (RTS) | 11 |
| Troverse stroke | 250 mm |
| Tube diameter | 108 mm |
| Maximum package diameter | 370 mm |
| Minimum cross-over angle | 6.14° |
| Switching speed of rotation of the reverse thread shaft (RTS) | 8286.3 rpm |
| Minimum double stroke number | 753 double strokes/min |
| Maximum double stroke number | 785 double strokes/min |

| Winding ratio | n-package | d-package | double strokes | n-RTS | i = g/W |
|---|---|---|---|---|---|
| 13.277 | 10316 | 108 | 777 | 8546.5 | .8285 |
| 12.773 | 10002 | 111 | 783 | 8613.3 | .861192 |
| 12.277 | 9622 | 116 | 784 | 8621.1 | 895984 |
| 11.821 | 9248 | 120 | 782 | 8606 | .930547 |
| 11.367 | 8905 | 125 | 783 | 8617.3 | .967714 |
| 11.277 | 8563 | 130 | 759 | 8352.5 | .975437 |
| 10.821 | 8495 | 131 | 785 | 8635.5 | 1.016542 |
| 10.419 | 8151 | 137 | 782 | 8606 | 1.055764 |
| 10.277 | 7849 | 142 | 764 | 8400.8 | 1.070351 |
| *9.919 | 7742 | 144 | 780 | 8585.4 | 1.108983 |
| 9.631 | 7472 | 149 | 776 | 8534.1 | 1.142145 |
| 9.277 | 7255 | 154 | 782 | 8602.5 | 1.185728 |
| *8.919 | 6988 | 159 | 784 | 8618.9 | 1.233322 |
| 8.631 | 6719 | 166 | 778 | 8562.8 | 1.274476 |
| 8.307 | 6502 | 171 | 783 | 8609.5 | 1.324184 |
| 8.277 | 6258 | 178 | 756 | 8316.4 | 1.328984 |
| *8.079 | 6235 | 179 | 772 | 8489.4 | 1.361555 |
| 7.773 | 6086 | 183 | 783 | 8612.5 | 1.415155 |
| 7.631 | 5855 | 190 | 767 | 8440.5 | 1.441489 |
| 7.367 | 5748 | 194 | 780 | 8583.3 | 1.493145 |
| 7.277 | 5550 | 201 | 763 | 8388.8 | 1.511612 |
| 7.079 | 5482 | 203 | 774 | 8518.1 | 1.553892 |
| 6.821 | 5333 | 209 | 782 | 8599.7 | 1.612667 |
| 6.631 | 5138 | 217 | 775 | 8523.8 | 1.658875 |
| 6.367 | 4995 | 223 | 785 | 8629.9 | 1.727658 |
| 6.277 | 4796 | 232 | 764 | 8405.1 | 1.75243 |
| *6.079 | 4728 | 236 | 778 | 8556.2 | 1.809508 |
| *5.853 | 4579 | 243 | 782 | 8606.3 | 1.879378 |
| 5.631 | 4409 | 253 | 783 | 8613 | 1.953472 |
| 5.419 | 4242 | 263 | 783 | 8610.5 | 2.029895 |
| 5.277 | 4082 | 273 | 774 | 8509.3 | 2.084518 |
| *5.079 | 3975 | 280 | 783 | 8609.4 | 2.165781 |
| *4.919 | 3826 | 291 | 778 | 8555.9 | 2.236227 |
| 4.773 | 3705 | 301 | 776 | 8539.8 | 2.30463 |
| 4.631 | 3596 | 310 | 776 | 8540.4 | 2.375297 |
| *4.449 | 3489 | 319 | 784 | 8625.3 | 2.472466 |
| 4.277 | 3351 | 332 | 784 | 8619.6 | 2.571896 |
| *4.151 | 3222 | 346 | 776 | 8537.8 | 2.649964 |
| *4.079 | 3127 | 356 | 767 | 8432.6 | 2.696739 |

-continued

| Winding ratio | n-package | d-package | double strokes | n-RTS | i = g/W |
|---|---|---|---|---|---|
| *3.919 | 3073 | 363 | 784 | 8624.6 | 2.806838 |

I claim:

1. A precision package comprising:

a tube having a central axis;

a winding of a winding material on said tube, said winding including a plurality of ribbon patterns spaced radially from each other, each of said ribbon patterns having a plurality of reverting loops along a circumferential edge of an axial end surface of said package, said circumferential edge being divided into a number of segments, the variation in the number of said reverting loops in each of said segments between two successive ribbon patterns being less than 8.

2. The precision package according to claim 1, wherein the length of each of said segments is one hundredth the length of said edge.

3. The precision package according to claim 1, wherein the length of each of said segments is one tenth the length of said edge, and said variation in the nunber of said reverting loops in each of said segments between two successive ribbon patterns is less than 4.

4. The precision package according to claim 1, wherein each of said ribbon patterns includes a plurality of winding material layers each of said layers being superimposed on radially inwardly disposed layers, a cross-over angle being formed by said superimposed layers, said cross-over angle varying less than 10%.

5. The precision package according to claim 2, wherein each of said ribbon patterns includes a plurality of winding material layers, each of said layers being superimposed on radially inwardly disposed layers, a cross-over angle being formed by said superimposed layers, said cross-over angle varying less than 10%.

6. The precision package according to claim 3, wherein each of said ribbon patterns includes a plurality of winding material layers, each of said layers being superimposed on radially inwardly disposed layers, said cross-over angle varying less than 10%.

7. The precision package according to claim 1, wherein said winding is formed by a rotational movement of said package and an axial movement of winding material being fed to said pakage, the relative speed of the two said movements defining a winding ratio, said winding ratio being selected from a group of unique decimal fractions.

8. The precision package according to claim 1, wherein each of said reverting loops is positioned in a different segment than the segments in which adjacent reverting loops are positioned.

9. A process for winding a winding material onto a tube to form a precision package, comprising:

rotating said tube to provide a constant circumferential winding speed to said package, reciprocating a winding material guiding head axially along said package, said winding material guiding head guiding said winding material axially along said package and forming reverting loops of winding material along segments of a circumferential edge of each axial end of said package, the rotating of said tube and the axial guiding of said winding material operating to form a plurality of ribbon patterns spaced radially from each other on said tube, and adjusting the ratio of the rotational speed of said tube with respect to the number of reciprocations made by said winding material guiding head to provide a variation in the number of reverting loops formed in each of said segments between two successive ribbon patterns of less than 8.

10. The winding process according to claim 9, wherein the length of each segment along which reverting loops are formed is one hundredth the length of said circumferential edge.

11. The winding process according to claim 9, wherein the length of each segment along which reverting loops are formed is one tenth the length of said circumferential edge.

12. The winding process according to claim 9, further comprising:

forming a plurality of winding material layers, each of said layers forming a cross-over angle in relation to adjacent layers, said cross-over angles being less than a predetermined maximum angle and greater than a predetermined minimum angle.

13. A winding process according to claim 12, wherein the difference between said minimum cross-over angle and said maximum cross-over angle is less than 10%.

14. The winding process according to claim 9, further comprising:

controlling said reciprocation of said winding material guiding head during adjustment of said ratio.

15. The winding process according to claim 14, further comprising:

changing the number of reciprocations of said winding material guiding head in an angle synchronous adjustment with respect to the rotation of said tube during said adjusting step.

16. A winding process according to claim 12, wherein said adjusting step is performed during a time of less than ten reciprocations of said winding material guiding head.

17. The winding process according to claim 9, wherein at least fifty consecutive reverting loops formed along said circumferential edge of said package are distributed over said segments along said circumferential edge such that no segment includes more than one of said reverting loops.

18. The winding process according to claim 9, further comprising:

maintaining a mean value of said ratio during an integration time period of at least two seconds, said mean value deviating from a predetermined mean value in only the fifth and subsequent decimal positions of said mean value.

19. A device for winding a winding material on a tube to form a precision package, said device comprising:

tube drive means to drive said tube at a constant circumferential speed, a winding material guiding head mounted for axial reciprocation along said tube;

rotary drive means to provide a rotary drive force to said winding material guiding head;

drive conversion means to convert said rotary drive force of said rotary drive means into a reciprocating drive force, said reciprocating drive force driving said winding material guiding head, package drive means to drive the package formed on said tube, said drive being imparted to a circumference of said package, control means to control said rotary drive means, said control means including first sensing means to sense the rotational speed of said rotary drive means and second sensing means to sense the rotary speed of said package, the ratio of the rotational speed of said rotary drive means and the rotational speed of said package being designated a transmission ratio, transmission ratio value storage means to store values of desired transmission ratios, between the rotational speeds of said rotary drive means and said package, and computer means connected with said second sensing means and said transmission ratio value storage means to provide a desired transmission ratio to said control means in response to a given package rotational speed, said control means adjusting said rotary drive means to conform with said transmission ratio.

20. The winding device according to claim 19, further comprising means to trigger said computer means to provide a transmission ratio to said control means, said trigger means operating in response to a predetermined parameter.

21. The winding device according to claim 19, further comprising third sensing means to sense the buildup of said package on said tube and to trigger said computer means to provide a transmission ratio to said control means, said computer means being triggered in response to a predetermined parameter.

22. The winding device according to claim 19, further comprising:

comparing means to compare an established transmission ratio with said stored transmission ratio values to determine a next highest transmission ratio to be delivered to said control means.

23. The winding device according to claim 19, further comprising:

transmission ratio value evaluation means to determine whether a given transmission ratio is acceptable for use in said winding device, said evaluation means including, multiplication means to provide first values equal to multiples of said given transmission ratio value, first limit signal supply means to provide first limit signal values, first comparison means to compare said first values with said first limit signal values, means to store said first values in specific storage areas in response to said first comparison, transfer means to store said given transmission ratio in said transmission ratio value storage means.

24. The winding device according to claim 23, further comprising means to indicate the number of storage areas which are occupied by said first values.

25. The winding device according to claim 23, wherein said transfer means includes:

second limit signal supply means to provide a second limit signal value, second comparison means to compare values equal to the number of said first values stored in each of said storage areas with said second limit signal value, and means to store said given transmission ratio in said transmission ratio value storage means in response to said second comparison means.

26. The winding device according to claim 19, said computer means further comprising deviation sensing means to sense the deviation of said transmission ratio from a desired transmission ratio value during a period of at least two seconds, said control means adjusting said transmission ratio in response to said deviation sensing means.

* * * * *